United States Patent [19]

Venaleck

[11] 4,030,799

[45] June 21, 1977

[54] JUMPER CONNECTOR

[75] Inventor: John T. Venaleck, Painesville, Ohio

[73] Assignee: A P Products Incorporated, Painesville, Ohio

[22] Filed: Feb. 9, 1976

[21] Appl. No.: 656,303

[52] U.S. Cl. ..... 339/99 R; 339/218 M; 339/278 C

[51] Int. Cl.[2] ..... H01R 9/08

[58] Field of Search ..... 339/99 R, 97 R, 97 P, 339/278 C, 218 M, DIG. 3, 174, 186 M, 213 R

[56] References Cited

UNITED STATES PATENTS

| | | | |
|---|---|---|---|
| 2,749,383 | 6/1956 | Pigman et al. | 339/99 R X |
| 2,795,770 | 6/1957 | Toedtman | 339/278 C |
| 3,444,506 | 5/1969 | Wedekind | 339/99 R |
| 3,820,058 | 6/1974 | Friend | 339/99 R |
| 3,912,354 | 10/1975 | Campbell et al. | 339/99 R |
| 3,980,380 | 9/1976 | Cieniawa et al. | 339/99 R |

*Primary Examiner*—Richard B. Lazarus
*Assistant Examiner*—Mark Rosenbaum
*Attorney, Agent, or Firm*—Donnelly, Maky, Renner & Otto

[57] ABSTRACT

A multiconductor electrical cable termination for flat ribbon cable has plural electrical contacts pierced through the cable insulation to engagement with respective conductors. The junctions of contacts and conductors are encapsulated in a base that forms an integral structure with the contacts and cable maintaining the junctions substantially free of oxygen and moisture. Plural openings in the base provide access to terminal portions of the contacts for test probing thereof, or the like, while the contacting portions of the contacts are connected to another termination, connector or the like.

18 Claims, 7 Drawing Figures

JUMPER CONNECTOR

BACKGROUND OF THE INVENTION

The present invention is directed to a multiconductor electrical cable termination and, more particularly, to a relatively permanent termination for a flat ribbon-like multiconductor electrical cable.

Since individual manual connection of each conductor in a multiconductor electrical cable, which usually has more than three conductors and as many as fifty or more conductors therein, would be a difficult and tedious task, a number of specialized connectors have been developed for simultaneously connecting each of the plural conductors to those of another multiconductor electrical cable via another connector, for example, to a plural signal input terminal of a computer or the like, to conductive paths on a printed circuit board or the like, etc. Typically these specialized connectors include multiple housing parts between which the cable is clamped, and usually before or during that clamping the multiple contacts of the connector puncture the electrical insulation of the cable to connect with respective conductors therein. The housing parts are mechanically secured in clamping engagement with the cable, and strain relief is usually provided by the clamping strength and/or by the terminal parts of the contacts pierced through the cable insulation.

SUMMARY OF THE INVENTION

In the present invention a multiconductor electrical cable termination is formed as an integral structural combination of the multiconductor electrical cable, the plurality of electrical contacts, and a housing part that is molded about at least a portion of each of the contacts and a portion of the cable. Each contact forms a junction with a respective conductor of the cable, and the integral housing part is molded under elevated temperature and pressure conditions so that each of the junctions is substantially fully encapsulated by at least one of the cable insulation and the molded body part and, thus, maintained relatively free of moisture and oxygen. The contacts and the conductors, therefore, may be of dissimilar metals, which will not corrode, oxidize or undergo any electrolysis-like activity due to the lack of moisture or oxygen at the junctions. Furthermore, the molded housing part preferably is of a material compatible with that of the electrical insulation of the cable so as to bond chemically therewith to provide an effective strain relief for the termination and also to insure the integrity of the encapsulation of the junctions. The terminal portion of each electrical contact preferably extends fully through the cable insulation, and openings provided in the molded housing part offer access to the ends of those terminal portions for test probing thereof. It will be appreciated that the contacting portion of each electrical contact, i.e., the portion being intended for electrical connection to a device other than the cable of the termination, may be of various designs for connection, for example, with pin contacts, female contacts, e.g., fork contacts, conductive paths on a printed circuit board, etc.

With the foregoing in mind it is a primary object of the invention to provide a multi-conductor electrical cable termination improved in the noted respects.

Another object of the invention is to maintain the junctions between the terminals and conductors of a multi-conductor electrical cable termination substantially free of moisture and oxygen.

An additional object of the invention is to provide integral molded strain relief for a multiconductor electrical cable termination.

A further object of the invention is to provide for test probing or the like of the electrical circuits in a multiconductor electrical cable termination and especially to provide such ability while the termination is connected to another device.

Still another object of the invention is to provide for the termination of a multi-conductor electrical cable having a plurality of closely positioned, electrically insulated conductors.

Still an additional object of the invention is to terminate in a facile manner a multi-conductor electrical cable and especially a flat, ribbon-like multi-conductor electrical cable.

These and other objects and advantages of the present invention will become more apparent as the following description proceeds.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
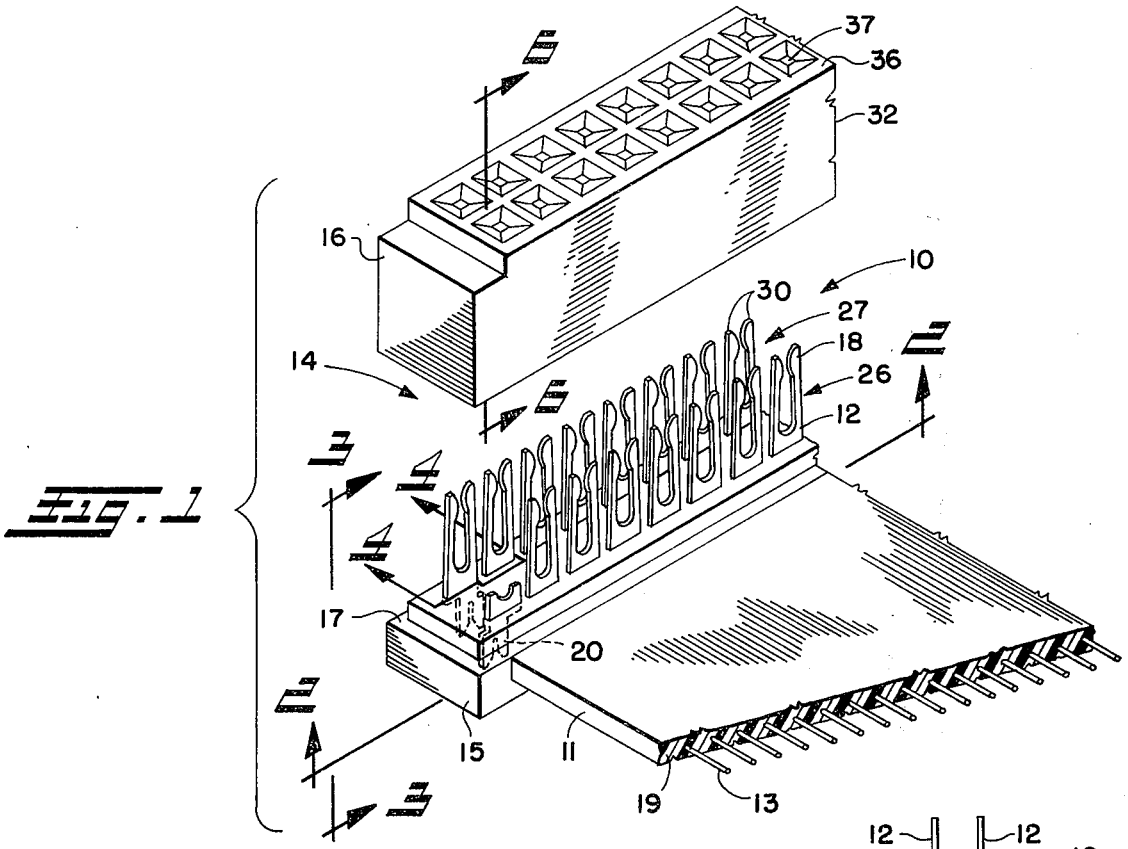
FIG. 1 is an exploded isometric view of the multiconductor electrical cable termination in accordance with the invention.
Figure 2:
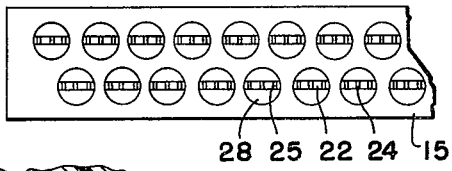
FIG. 2 is a bottom view of the molded housing part of the multiconductor electrical cable termination looking in the direction of the arrows 2—2 of FIG. 1.

Referring now more specifically to the drawing, wherein like reference numerals designate like parts in the several figures, and initially to FIGS. 1 through 5, a multiconductor electrical cable termination is generally indicated at 10. The fundamental parts of the termination 10 include a multi-conductor electrical cable 11, a plurality of electrical contacts 12 for connection at respective junctions to the respective conductors 13 of the cable, and a housing 14 having a base body part 15 molded about at least a portion of each of the contacts and a portion of the cable to an integral structure therewith.

In the illustrated preferred embodiment of the invention the housing 14 also includes a cover 16 adapted to fit onto the base 15 at a peripheral step 17 of the latter for appropriate containment of the contacting portions 18 of the electrical contacts 12; however, it will be appreciated that the form of the cover 16 and its possible elimination will depend on the particular style of the contacting portions 18. For example, if the contacting portions 18 were simply points to be soldered in plated through openings of a printed circuit board or the like rather than of the illustrated fork-like style, the cover 16 can be eliminated from the termination 10.

Figure 4:
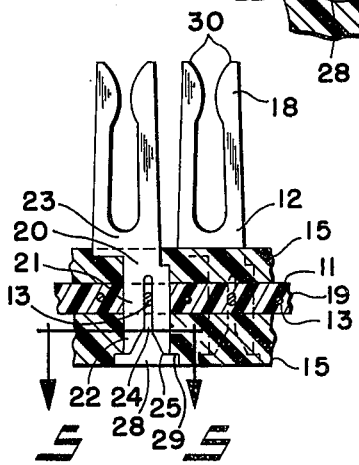
FIG. 4 is a partial section view at two relatively spaced apart generally vertical planes of the multiconductor electrical cable termination looking in the direction of the stepped arrows 4—4 of FIG. 1.

Preferably, the composition of the material of which the base 15 is formed and the composition of the electrical insulation 19, which maintains the conductors 13 in parallel spaced-apart locations, are similar or compatible so that when the base 15 is molded it will chemically bond to the insulation 19 further to increase the integrity of the structure of the termination 10 and at the same time to provide a molded strain relief that precludes separation of the contact terminal portions 20 from their respective junctions 21 with the conductors 13, which are seen most clearly in FIG. 4.

As shown in FIG. 4, the junctions 21 are encapsulated by the insulation 19 and the molded body of the base 15, and in the preferred form of the invention the body 15 is molded about portions of the electrical contacts 12 and cable 11 under the elevated temperatures and pressures used in an injecting molding machine, whereby any moisture and/or oxygen at the junction 21 is substantially eliminated during the molding process. Therefore, the material of which the electrical contacts 12 are formed and the material of which the conductors 13 are formed may be dissimilar without encountering corrosion, oxidation or electrolysis-like activity at the junctions 21, which will remain effective electrical connections between the electrical contacts and the respective conductors regardless of the external environment to which the termination 10 is subsequently subjected. Moreover, since the base material and the insulation material chemically bond during molding of the base, the integrity of the encapsulation at each junction is further enhanced. Therefore, the relatively expensive copper or plated conductors 13 may be effectively terminated, for example, by less expensive aluminum electrical contacts 12.

The terminal portion 20 of each electrical contact 12 preferably includes a pair of elongate prong-like arms 22 commonly supported from a base portion 23 and defining a relatively narrow slot 24 therebetween. The ends of the arms 22 remote from the base portion 23 preferably are tapered or chamfered to define an entranceway into the narrow slot 24 and to form generally pointed tips 25 to pierce easily through the cable insulation 19. The width of the narrow slot 24 is preferably narrower than the normal diameter of the conductor 13. Therefore, as a typical electrical contact 12 is joined with the cable 11 by urging the two toward each other, the pointed tips 25 pierce through the insulation 19 while the wide chamfered entrance-way guides the conductor 13 into the narrow slot 24. As the conductor 13 enters the slot, it is somewhat flattened to provide a relatively enlarged surface area of engagement or connection with the two arms 22.

The terminal portion 20 of each electrical contact 12 is in the same plane and is offset with respect to the contacting portion 18 thereof, as can be seen most clearly in FIGS. 1 and 4. As seen particularly in FIG. 1, the electrical contacts 12 in the forward row 26 have their terminal portions offset to the left with respect to their contacting portions, and the electrical contacts in the rearward row 27 have their terminal portions offset to the right with respect to the contacting portions. This offset configuration of the electrical contacts 12 allows them to be of reasonable size and strength while the contacting portion of each contact in one row is directly aligned with the contacting portion of an opposite contact in the other row and with each of the relatively closely positioned parallel conductors 13 being connected to only a single respective contact 12. It will be appreciated that although the illustrated invention utilizes two rows of contacts, the principles of the invention may be, of course, employed in terminations having one row or more than two such rows of contacts or any other arrangement thereof.

Figure 3:
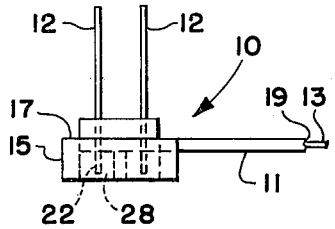
FIG. 3 is an end elevation view of the multiconductor electrical cable termination looking in the direction of the arrows 3—3 of FIG. 1.
Figure 5:
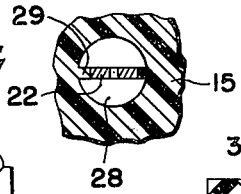
FIG. 5 is a partial section view at a test probe opening of the multiconductor electrical cable termination looking in the direction of the arrows 5—5 of FIG. 4.

Each of the contact terminal arms 22 is preferably sufficiently long to extend fully through the cable 11 with a portion, for example, including the pointed ends 25, being exposed beyond the plane of the cable, as is illustrated most clearly in FIGS. 3 and 4. When the base body 15, then, is molded about portions of the contacts and cable, openings or holes 28, which are seen most clearly in FIGS. 2 through 5, are formed in the base to allow those portions of the arms 22 to remain exposed. Therefore, when the multiconductor electrical cable termination 10 is connected, for example, to another connector, to a computer, to a printed circuit board or the like, with the conductors 13 operatively carrying respective electrical signals, each of the circuits in which the respective conductors 13 are connected may be tested, for example, by insertion of a probe from a test instrument or the like in the respective openings 28 to engagement with the exposed arms 22. Also, during the molding of the base body 15 ledges 29 are formed behind each of the arms 22 to prevent such an inserted probe from separating the arms and disturbing the sealed encapsulated and electrical integrity of the junction 21.

Figure 6:
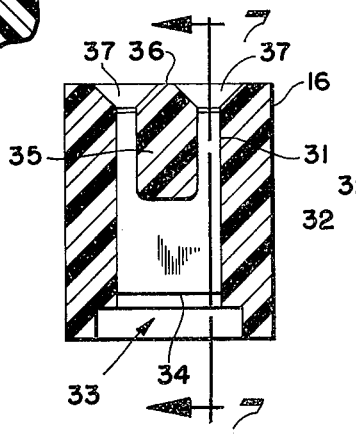
FIG. 6 is an end elevational section view of the housing cover of the multiconductor electrical cable termination looking in the direction of the arrows 6—6 of FIG. 1.
Figure 7:
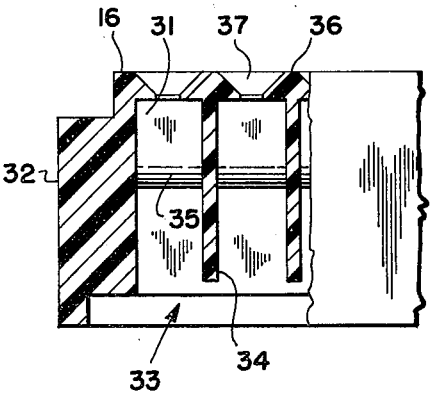
FIG. 7 is a partial side elevation view, mostly in section, of the housing cover looking in the direction of the arrows 7—7 of FIG. 6.

As illustrated in FIG. 1, for example, each of the electrical contacts 12 is of the fork contact type whereby each of the contact portions 18 comprises a pair of generally parallel elongate arms 30 adapted for electrical and mechanical connection with a pin contact, for example, inserted therebetween. The housing cover 14, which is illustrated in FIGS. 1, 6 and 7, preferably is also injection molded as a separate part of dielectric material such as, for example, plastic with chambers 31 therein for containment of the arms 30. The cover 16 has an outer wall 32 open at the bottom 33 to receive respective pairs of elongate contact arms 30 in the respective chambers 31, which are defined by the outer wall 32 and by internal walls 34, 35. In the cover top 36 are a plurality of apertures 37 for guiding respective pin contacts or the like into the respective chambers 30 between the two arms 30 of the respective electrical contacts 12 for mechanical and electrical engagement therewith. The opening at the cover bottom 33 is also stepped for joining at the step 17 of the base 15.

Upon completing the formation and/or assembly of the multiconductor electrical cable termination 10, it may be easily connected to another electrical connector, a plural signal input terminal of a computer, conductive paths on a printed circuit board, or the like to connect the conductors 13 in respective circuits.

In addition to the above express and implied advantages of the multiconductor electrical cable termination 10 of the present invention, the termination may be produced relatively more efficiently than the prior art clamping type specialized connectors previously used to terminate flat multiconductor ribbon-like cable, for example, by inserting the electrical contacts 12 in the cable 11 and molding the base body 15 of the housing 14 thereabout at the same work station of an injection molding machine substantially to complete the formation of the termination in a single step. Thereafter, if the housing 14 is to include a cover 16, the latter may be easily fitted to the base 15 at the step 17 and secured thereto, for example, by accoustical or ultrasonic welding techniques.

Moreover, while the invention is illustrated and described above with reference to multiconductor electrical cable termination 10 located at an end of the multiconductor electrical conductor 11, it will be apparent that such a termination also may be provided in accordance with the invention at a location on a multiconductor electrical cable intermediate the ends thereof.

I claim:

1. A multiconductor electrical cable termination, comprising:

a multiconductor electrical cable including a plurality of conductors and electrical insulation about said conductors maintaining the latter electrically insulated from each other, a plurality of electrical contacts, each including terminal means connecting at least one of said conductors directly through said electrical insulation to form an electrical junction, and contacting means on each of said contacts for electrically connecting each of said contacts to an external member placed to engagement therewith, and a housing including base means for directly holding said contacts and said cable in relatively fixed position, said base means comprising a body integrally molded about at least a portion of each of said contacts and a portion of said cable, whereby said base means, said contacts and said cable form an integral structure.

2. A multiconductor electrical cable termination as set forth in claim 1, wherein each of said junctions is sealed in air-tight and relatively moisture-free and oxygen-free condition by at least one of said electrical insulation and said housing body.

3. A multiconductor electrical cable termination as set forth in claim 2, wherein said conductors and said electrical contacts are of dissimilar metals.

4. A multiconductor electrical cable termination as set forth in claim 2, wherein said multiconductor electrical cable comprises flat ribbon-like cable, and said housing body comprises a material that chemically bonds with said electrical insulation during molding of said body.

5. A multiconductor electrical cable termination as set forth in claim 1, wherein said terminal means comprises piercing means for piercing said electrical insulation to engage a conductor therein.

6. A multiconductor electrical cable termination as set forth in claim 5, wherein said piercing means comprises prong-like arm means for deforming such engaged conductor to enlarge the surface area of said junction.

7. A multiconductor electrical cable termination as set forth in claim 6, wherein at least one of said body and said electrical insulation fully encapsulates said junctions in fluid-tight relation.

8. A multiconductor electrical cable termination as set forth in claim 1, wherein at least one of said body and said electrical insulation fully encapsulate said junctions and said body is molded under elevated temperature and pressure conditions whereby said encapsulated junctions are substantially free of moisture and oxygen.

9. A multiconductor electrical cable termination as set forth in claim 1, wherein said body comprises a material compatible with that of said electrical insulation to bond chemically with the latter upon molding of said body under elevated temperatures and pressure conditions.

10. A multiconductor electrical cable termination as set forth in claim 1, wherein said terminal means of each electrical contact comprises at least one elongate arm of a sufficient length to extend on both sides of said electrical insulation, and said body comprises hole means for access to said elongate arms, whereby a test probe or the like can be inserted to electrical engagement with said elongate arms.

11. A multiconductor electrical cable termination as set forth in claim 10, wherein said terminal means comprises two elongate arms.

12. A multiconductor electrical cable termination as set forth in claim 11, wherein said multiconductor electrical cable comprises flat ribbon-like cable, and said terminal means comprises means for piercing said electrical insulation upon forcing one of said cable and said electrical contacts relatively together.

13. A multiconductor electrical cable termination as set forth in claim 1, wherein said housing further comprises cover means for containment of said contacting means of said electrical contacts.

14. A multiconductor electrical cable termination as set forth in claim 1, wherein said contacting means comprise fork-like arms.

15. A multiconductor electrical cable termination as set forth in claim 1, wherein said multiconductor electrical cable comprises a flat ribbon-like cable having more than three conductors therein.

16. A multiconductor electrical cable termination as set forth in claim 15, wherein said terminal means and said contacting means of each electrical contact are linearly offset with respect to each other, whereby said contacts may be relatively closely positioned in plural rows in said body while respectively connecting with each of said closely positioned conductors.

17. A multiconductor electrical cable termination as set forth in claim 15, wherein said multiconductor electrical cable has from about twenty to about fifty conductors.

18. A multiconductor electrical cable termination as set forth in claim 10, wherein said body substantially encapsulates the area of said respective electrical junctions, and said elongate arms extend beyond such encapsulated areas for exposure in said hole means.

* * * * *